US011293433B2

(12) United States Patent
Deichmann et al.

(10) Patent No.: US 11,293,433 B2
(45) Date of Patent: Apr. 5, 2022

(54) SCREW SPINDLE PUMP, FUEL PUMP ASSEMBLY, AND FUEL PUMP UNIT

(71) Applicant: Vitesco Technologies GmbH, Hannover (DE)

(72) Inventors: Johannes Deichmann, Rotenburg (DE); Tim Gonnermann, Wehretal (DE); Marc Völker, Magdeburg (DE)

(73) Assignee: Vitesco Technologies GmbH, Hannover (DE)

( * ) Notice: Subject to any disclaimer, the term of this patent is extended or adjusted under 35 U.S.C. 154(b) by 162 days.

(21) Appl. No.: 16/626,443

(22) PCT Filed: Jun. 18, 2018

(86) PCT No.: PCT/EP2018/066150

§ 371 (c)(1),
(2) Date: Dec. 24, 2019

(87) PCT Pub. No.: WO2019/002005

PCT Pub. Date: Jan. 3, 2019

(65) Prior Publication Data

US 2020/0132070 A1 Apr. 30, 2020

(30) Foreign Application Priority Data

Jun. 27, 2017 (DE) ..... 10 2017 210 771.5

(51) Int. Cl.
*F01C 1/16* (2006.01)
*F03C 2/00* (2006.01)
(Continued)

(52) U.S. Cl.
CPC ..... *F04C 2/165* (2013.01); *F04C 11/008* (2013.01); *F01C 21/02* (2013.01); *F01C 21/108* (2013.01);
(Continued)

(58) Field of Classification Search
CPC .. F04C 2/082; F04C 2/16; F04C 2/165; F04C 11/008; F04C 15/0042; F04C 15/0073;
(Continued)

(56) References Cited

U.S. PATENT DOCUMENTS 2,922,377 A * 1/1960 Whitfield ..... F04C 18/16 418/201.3
3,097,359 A * 7/1963 Cowles et al. ..... F04C 18/16 418/203
(Continued)

FOREIGN PATENT DOCUMENTS

CN 1768206 5/2006
CN 101634297 1/2010
(Continued)

OTHER PUBLICATIONS

Office Action dated Apr. 15, 2021 issued in Chinese Patent Application No. 201880037848.8.
(Continued)

*Primary Examiner* — Theresa Trieu
(74) *Attorney, Agent, or Firm* — Cozen O'Connor

(57) ABSTRACT

A screw-spindle pump comprising: first and second screw spindles forming running and drive spindles, respectively, and a pump housing configured to receive the first and second screw spindles. The first and second screw spindles form, with at least the pump housing, delivery chambers, moving from a suction side to a pressure side of the pump as a consequence due to rotation of the screw spindles. The pump housing has an elongate insert, as an abutment for the first and second screw spindles and against which the first and second screw spindles are supported, the elongate insert having a first portion forming a first abutment for the second screw spindle and a second portion forming a second abutment for the first screw spindle. The elongate insert is
(Continued)

clamped into a receptacle of the pump housing using a cross-sectional dimension of the elongate insert.

9 Claims, 3 Drawing Sheets

(51) Int. Cl.

| | |
|---|---|
| ***F03C 4/00*** | (2006.01) |
| ***F04C 18/00*** | (2006.01) |
| ***F04C 2/16*** | (2006.01) |
| ***F04C 11/00*** | (2006.01) |
| *F01C 21/02* | (2006.01) |
| *F01C 21/10* | (2006.01) |
| *F04C 2/08* | (2006.01) |
| *F04C 15/00* | (2006.01) |

(52) U.S. Cl.
CPC ..... *F04C 2/082* (2013.01); *F04C 15/0042* (2013.01); *F04C 2210/1044* (2013.01); *F04C 2230/60* (2013.01); *F04C 2240/30* (2013.01)

(58) Field of Classification Search
CPC ..... F04C 2210/1044; F04C 2230/60; F04C 2240/30; F01C 21/02; F01C 21/104; F01C 21/108
See application file for complete search history.

(56) References Cited

U.S. PATENT DOCUMENTS

| | | | | |
|---|---|---|---|---|
| 3,275,226 | A * | 9/1966 | Whitfield | F04C 18/16 418/203 |
| 9,404,494 | B2 | 8/2016 | Joistgen | |
| 2004/0241016 | A1* | 12/2004 | Beaven | F04C 2/165 417/410.4 |
| 2006/0222553 | A1 | 10/2006 | Scholz et al. | |
| 2008/0038137 | A1* | 2/2008 | Inagaki | F04C 18/16 418/201.1 |
| 2009/0255515 | A1* | 10/2009 | Eck | F02M 37/106 123/509 |
| 2015/0240810 | A1 | 8/2015 | Metz et al. | |

FOREIGN PATENT DOCUMENTS

| | | | | |
|---|---|---|---|---|
| DE | 672 700 | | 3/1939 | |
| DE | 813 341 | | 9/1951 | |
| DE | 10 2006 049 663 | | 5/2008 | |
| DE | 10 2014 102 390 | | 3/2015 | |
| WO | WO-2017009082 | A1 * | 1/2017 | F04D 29/0467 |

OTHER PUBLICATIONS

International Search Report issued in corresponding PCT Application PCT/EP2018/066150.
Written Opinion issued in corresponding PCT Application PCT/EP2018/066150.
Office Action issued in corresponding German Application No. 10 2017 210 771.5.

* cited by examiner

SCREW SPINDLE PUMP, FUEL PUMP ASSEMBLY, AND FUEL PUMP UNIT

CROSS REFERENCE TO RELATED APPLICATIONS

This is a U.S. national stage of International application No. PCT/EP2018/066150, filed on Jun. 18, 2018, which claims priority to German Application No. 10 2017 210 771.5, filed Jun. 27, 2017, the content of each of which is incorporated herein by reference.

BACKGROUND OF THE INVENTION

1. Field of the Invention

The present invention relates to a screw-spindle pump, to a fuel delivery assembly comprising such a screw-spindle pump and to a fuel delivery unit comprising such a fuel delivery assembly, for use in vehicles, in particular in passenger motor vehicles and/or utility vehicles.

2. Description of the Prior Art

Screw-spindle pumps—also referred to as screw pumps—are positive displacement pumps whose displacer has the form of a spindle screw. Two oppositely running screw spindles, which are formed with a threaded profiling, engage into one another and displace a delivery medium, which may for example be a fuel—for example gasoline or diesel fuel—for an internal combustion engine of a passenger motor vehicle and/or a utility vehicle. The combination of the spindle screws and a pump housing in which the screw spindles are arranged and guided is also referred to as a pump stage. The two screw spindles form, in combination with the pump housing, delivery chambers for the delivery medium. The delivery chambers travel from a suction side or inlet side to a pressure side or outlet side of the pump or pump stage as a consequence of a rotation of the screw spindles, and thereby transport the sucked-in delivery medium.

Within the context of the present disclosure, the terms pump and pump stage are to be understood as meaning one and the same object.

Pumps of this type are used, for example, in fuel delivery assemblies or fuel pumps of vehicles, in particular of passenger motor vehicles and/or utility vehicles. Within the context of the present disclosure, the terms fuel delivery assembly and fuel pump are to be understood as meaning one and the same object, which, in addition to a pump or pump stage, also comprises an electric motor as a drive.

The prior art has disclosed pumps of the above-described type, which are provided on the suction side with a planar abutment surface against which the screw spindles abut and are thus supported. In this case, the planar abutment surface belongs to a cuboidal insert element composed of metal, which functions as an abutment element and is preferably arranged in a pump cover. By way of this insert element, an operationally induced axial displacement of the screws is intercepted.

The "driving" screw may in this case be supported on the pressure side against the pump housing via a coupling, whereas the "driven" screw may be supported on the pressure side via a peg which is injection molded on the pump housing. For the purpose of clarification, these supports are generally to be understood in each case as being an emergency support. As already mentioned above, the actual support of the two screw spindles is, for operationally related reasons, realized on the suction side against an axial abutment provided on the housing side for this purpose.

SUMMARY OF THE INVENTION

An object of one aspect of the present invention is to provide an improved pump of the above-described type. This object is achieved by a screw-spindle pump stage having at least two screw spindles, which comprise a drive spindle and a running spindle that runs oppositely with respect to the drive spindle, and a pump housing for receiving the two screw spindles.

The two screw spindles form, at least in combination with the pump housing, delivery chambers, which move from a suction side or inlet side to a pressure side or outlet side of the pump as a consequence of a rotation of the screw spindles. Or, put differently, the delivery chambers move in the direction of the pressure side of the pump or pump stage as a consequence of a rotation of the screw spindles.

In principle, it would also be possible for such screw spindles to form the delivery chambers in combination with a pump housing, with a pump cover and possibly with an additional element or insert element, wherein the additional element may be arranged within the pump housing and/or the pump cover.

The pump housing has, in this case, at least one elongate insert, which functions as an abutment for the screw spindles and against which the screw spindles are supported and which forms a first abutment for the drive spindle and a second abutment for the running spindle.

It is proposed here that the elongate insert is clamped into a corresponding receptacle of the pump housing utilizing a cross-sectional dimension of the insert. Here, for the purpose of clamping, it is possible to provide, for example, a correspondingly selected transition fit which effects a clamping action.

The cross-sectional dimension of the elongate insert, which is to be understood as being either a height dimension or width dimension, is, in comparison with its length dimension, which is to be understood as being that dimension of the insert relating to the length extent, subject here to a lower tolerance. This has the advantage that the height and width dimensions, in comparison with the length dimension, of the elongate insert or inserts are more controllable in terms of production.

For the purpose of clarification, it should be expressly mentioned here that the cross-sectional dimension which serves for clamping in the use position of the insert is either the width dimension or the height dimension of the insert. Furthermore, within the context of the present disclosure, the cross-sectional dimension which actually serves for clamping in the use position of the insert may be understood as being the clamping dimension of the insert, wherein the clamping dimension in the use position of the insert is to be understood at all times as being the width dimension.

The clamping proposed here reduces the wear of the pump or pump stage, specifically for the following reasons:

If it is sought to generate the clamping of the insert into the receptacle of the pump housing utilizing the length dimension of the insert, then the clamping, owing to the less effective controllability in terms of production, is associated with undesirable chip formation, which has to be correspondingly accommodated on the pump housing side. If this chip accommodation cannot be ensured on the pump housing side, there is also associated therewith the risk of chips being flushed into the pump or pump stage, wherein the chips can contaminate the delivery chambers. Such contamination in turn leads to wear between the screw spindles and the associated pump housing section that is increased for friction-related reasons, wherein, in the worst case, the increased wear even leads to the pump or pump stage being damaged.

By contrast, if the insert is clamped into the receptacle of the pump housing utilizing the height dimension or width dimension in the use position of the insert, the aforementioned chip formation with friction-increasing effect does not occur at all. In this respect, the clamping proposed here reduces the wear of the pump or pump stage.

Here, the insert, with respect to the cross-sectional dimension, may be formed such that the width dimension is equal to the height dimension. This corresponds to an at least sectionally square cross-sectional shape of the insert.

On the pump housing, there may be formed here at least one sectionally formed projection, which forms the receptacle and extends from the pump housing into an inlet opening of the pump housing in a manner transverse to the longitudinal direction of the pump housing, wherein the at least one insert is clamped at the at least one projection utilizing the height dimension or width dimension of the insert.

The aforementioned sectionally formed projection is to be understood here as meaning a web-like projection which extends from a diameter delimiting an inlet opening of the pump housing into the inlet opening, or projects from this diameter into the inlet opening. Here, the diameter does not necessarily have to be understood in relation to a circular inlet opening, but rather as a contour circumscribing an inlet.

The at least one projection results in the shortening of the length of the insert, which, as is known, is produced from a metal, wherein such a metal, in comparison with a plastic, from which, as is known, the pump housing may be produced, can be more expensive. Added to this is the fact that the plastic is lighter in comparison with the metal. As a result, this contributes to saving of costs and weight.

According to one aspect of the present invention, on the pump housing, there may be formed a first projection and a second projection, which form the receptacle, wherein the two projections extend into the inlet opening of the pump housing, wherein the insert is clamped at the two projections utilizing the height dimension or width dimension of the insert. This further contributes to the aforementioned saving of costs and weight.

Here, the at least one projection may be formed in a manner orthogonal to the longitudinal direction of the pump, it however being preferable for the two aforementioned projections to be formed in a manner orthogonal to the longitudinal direction of the pump.

According to a further aspect of the present invention, the pump housing may have a pump housing section formed transverse to the longitudinal direction of the pump and on which the at least one projection is formed, it however being preferable for the two aforementioned projections to be formed thereon. The pump housing section may in this case be formed in a manner orthogonal to the longitudinal direction of the pump. This pump housing section also makes possible further shortening of the length of the insert.

According to a further aspect of the present invention, the first projection and the second projection may be formed on the pump housing in a manner diametrically opposite one another.

The at least one elongate insert may, for example, be cuboidal or prismatic in form. With regard to the shaping of the insert, however, further variations are also conceivable. It is merely necessary to ensure an elongate formation of the insert such that the aforementioned proposed clamping can be realized sectionally via either the width dimension of the insert or the height dimension of the insert.

The insert may furthermore be formed from a ceramic, a metal or a plastic. Here, a ceramic or a metal is particularly characterized by its hardness, by which, as is known, it is possible for friction to be reduced and for wear resistance to be promoted.

According to a further aspect of the invention, the pump housing may have a pump cover, or be supplemented by a pump cover, having the at least one projection formed in a manner transverse, preferably orthogonal, to the longitudinal direction of the pump, in which the at least one insert is clamped. Here, the pump cover may expediently also have the two aforementioned projections formed in a manner transverse, preferably orthogonal, to the longitudinal direction of the pump. The pump cover may in this case be regarded as a part for receiving the screw spindles that belongs to the pump housing.

According to a further aspect of the present invention, the pump housing and/or the pump cover may be formed as injection moldings/an injection molding.

Also proposed is a fuel delivery assembly having an electric motor and having a screw-spindle pump, or screw-piston pump stage, which is driven by the electric motor.

A fuel delivery unit for use in a fuel tank of a vehicle is also proposed. A "vehicle" is to be understood here as meaning any type of vehicle which has to be supplied with a liquid and/or gaseous fuel for operation, but in particular passenger motor vehicles and/or utility vehicles.

Here, the fuel delivery unit comprises a fuel delivery assembly of the above-described type, and a swirl pot in which the fuel delivery assembly is arranged in order for fuel to be delivered from the swirl pot to an internal combustion engine.

BRIEF DESCRIPTION OF THE DRAWINGS

The invention will be discussed in detail in the following text with reference to the illustrations in the figures. Further advantageous refinements of the invention emerge from the description below of preferred embodiments.

In the drawings.

DETAILED DESCRIPTION OF THE PRESENTLY PREFERRED EMBODIMENTS

Figure 1:
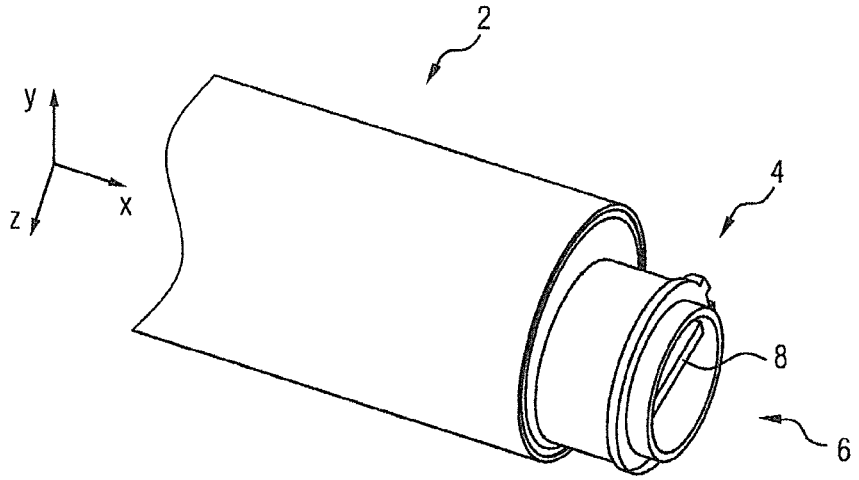
FIG. 1 shows a perspective illustration of a fuel delivery assembly known from the prior art, with a screw-spindle pump stage.

FIG. 1 illustrates a fuel delivery assembly 2, which is known from the prior art and comprises a screw-spindle pump 4, also referred to as a screw-spindle pump stage, on the suction side. Here, the screw-spindle pump 4 is joined to an electric motor and is rolled together with the latter by a sheet-metal casing or sheet-metal cylinder to form a unit. In this illustration, the electric motor is concealed by the sheet-metal casing or sheet-metal cylinder. Visible on the pump side is an inlet opening 6, via which a fuel is sucked in. Visible in the inlet opening 6 is an elongate insert 8 in the form of a feather key, which functions as an abutment element and against which the screw spindles 14, 16 of the pump 4 are supported during operation and which forms a first abutment for a drive spindle 16 and a second abutment for a running spindle 14.

Figure 2:
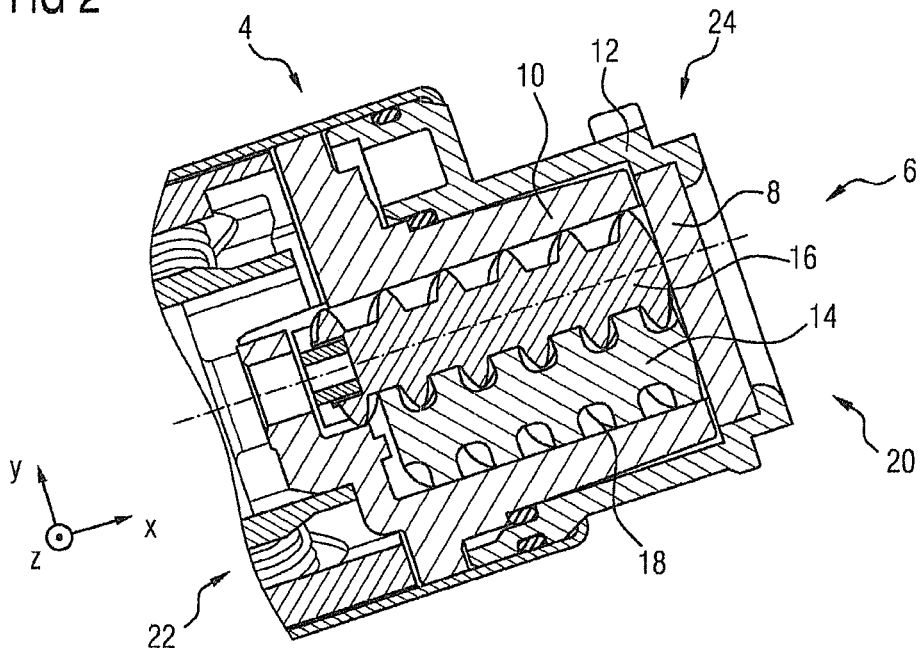
FIG. 2 shows a sectional illustration of the screw-spindle pump stage from FIG. 1, with an arrangement, known from the prior art, of a longitudinal insert.

FIG. 2 illustrates the pump or pump stage 4, which comprises the drive spindle 16 and the running spindle 14, which runs oppositely with respect to the drive spindle 16. The pump 4 also comprises a pump housing 10 and a pump cover 12 for receiving the two screw spindles 14, 16. Also arranged in the pump cover 12, in a clamping manner, is the aforementioned feather key-type insert 8 which functions as an abutment element and against which the two screw spindles 14, 16 abut.

Here, the two screw spindles 14, 16 form, together with the pump housing 10, delivery chambers 18, which move from a suction side 20 to a pressure side 22 of the pump 4 as a consequence of a rotation of the screw spindles 14, 16. Or, put differently, the delivery chambers 18 move in the direction of the pressure side 22 as a consequence of a rotation of the screw spindles 14, 16.

Here, the pump cover 12 has a pump housing section 24 arranged in a manner orthogonal (cf. Y-Y direction or transverse direction) to a longitudinal direction X-X of the pump 4 and from which a peripheral projection extends into the inlet opening 6 of the pump cover 12 in a manner orthogonal to the longitudinal direction X-X. The peripheral projection delimits the inlet opening 6.

The insert 8 (or the feather key 8) is clamped, or placed in a clamping manner, into the receptacle of the pump cover 12 utilizing the length dimension of the insert, and at the same time bears against two projections 26*a*, 26*b*, which extend from the aforementioned peripheral projection into the inlet opening 6 of the pump cover 12 (cf. FIG. 2). The two projections 26*a*, 26*b* form a receptacle for the insert 8.

This type of clamping is associated with chip formation, which has to be accommodated as such on the pump housing side or by the pump cover 12. For this purpose, slots are formed in the receptacle of the cover 12 for the feather key and serve as a collector for the chips. In principle, for this solution, there is the risk of chips being flushed into the pump or pump stage, wherein the chips can contaminate the delivery chambers. Such contamination in turn leads to wear between the screw spindles and the associated pump housing section that is increased for friction-related reasons and that, in the worst case, can even lead to the pump or pump stage being damaged.

Figure 3:
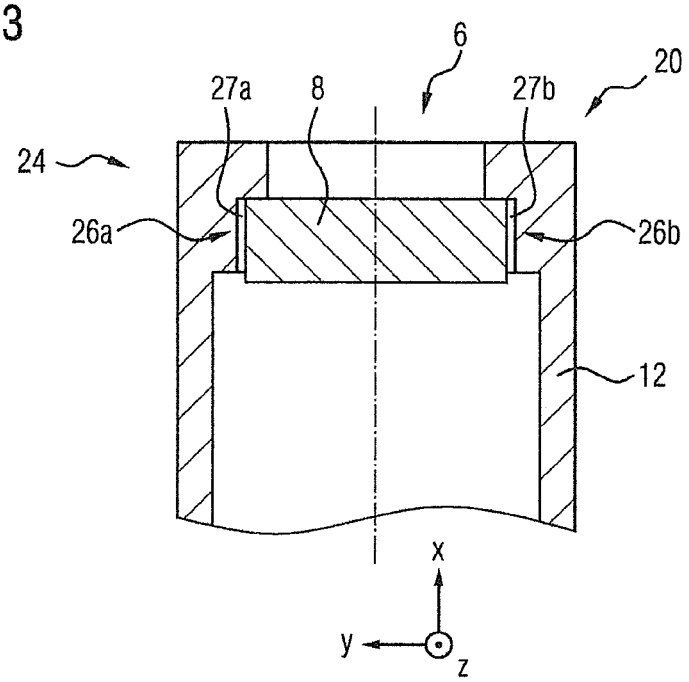
FIG. 3 shows a first schematic sectional illustration of a proposed pump cover of a screw-spindle pump stage.

FIG. 3 schematically illustrates a first embodiment of the invention, in which a pump cover 12 produced by injection molding—as part of a pump housing for receiving two screw spindles—is provided with two projections 26*a*, 26*b* which are formed sectionally and in a manner orthogonal to a longitudinal direction X-X of the pump cover 12. A first sectionally formed projection 26*a* and a second sectionally formed projection 26*b* are in this case formed on a pump housing section 24 in the region of the suction-side end of the pump cover 12 and extend into an inlet opening 6 of the pump cover 12. The two projections 26*a*, 26*b*, which are of web-type form, are in this case formed on the pump cover 12 in a manner diametrically opposite one another, wherein an elongate insert 8 in the form of a cuboid composed of, for example, a metal or a ceramic, bears against the two projections 26*a*, 26*b* in a clamping manner. Here, the two projections form a receptacle into which the cuboid 8 is clamped utilizing one of the cross-sectional dimensions of the cuboid, that is to say either the width dimension thereof or the height dimension thereof. It can be seen that the cuboid 8, with respect to the longitudinal extent thereof, has at both ends a desired spacing 27*a*, 27*b* to the receptacle, and as a result clamping into the receptacle utilizing the length dimension of the cuboid does not occur, avoiding the aforementioned disadvantages known from the prior art.

The cuboid 8, with respect to its cross section, may in this case have, for example, equal sides. As an alternative to such a square formation of the cuboid cross section, a non-square rectangular cross-sectional formation is also conceivable. With regard to the shaping of the insert 8, numerous variations are in principle conceivable. It is merely necessary to ensure an elongate formation of the insert such that the clamping of the insert into the receptacle can be realized sectionally via either the width dimension of the insert or the height dimension of the insert.

Figure 4:
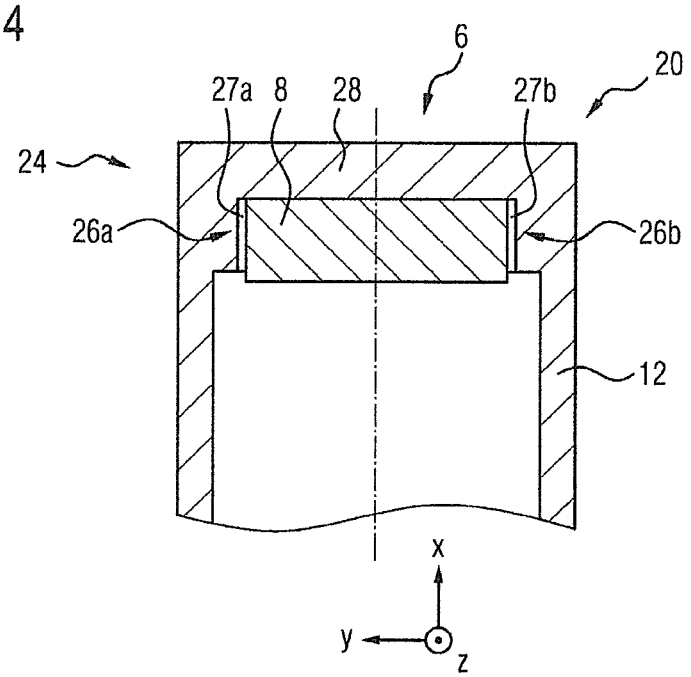
FIG. 4 shows a second schematic sectional illustration of a proposed pump cover of a screw-spindle pump stage.

FIG. 4 schematically illustrates a second embodiment of the invention. In comparison with the first embodiment, sthe second embodiment differs merely in that, above the insert 8 in the illustration shown, that is to say on the inlet side or suction side with respect to the insert 8, provision is made of a web section 28 which connects the two projections 26*a*, 26*b* to one another. The web section 28 thus provides a further support for the cuboidal element 8, against which the screw spindles 14, 16 of the pump or pump stage 4 are supported.

Figure 5:
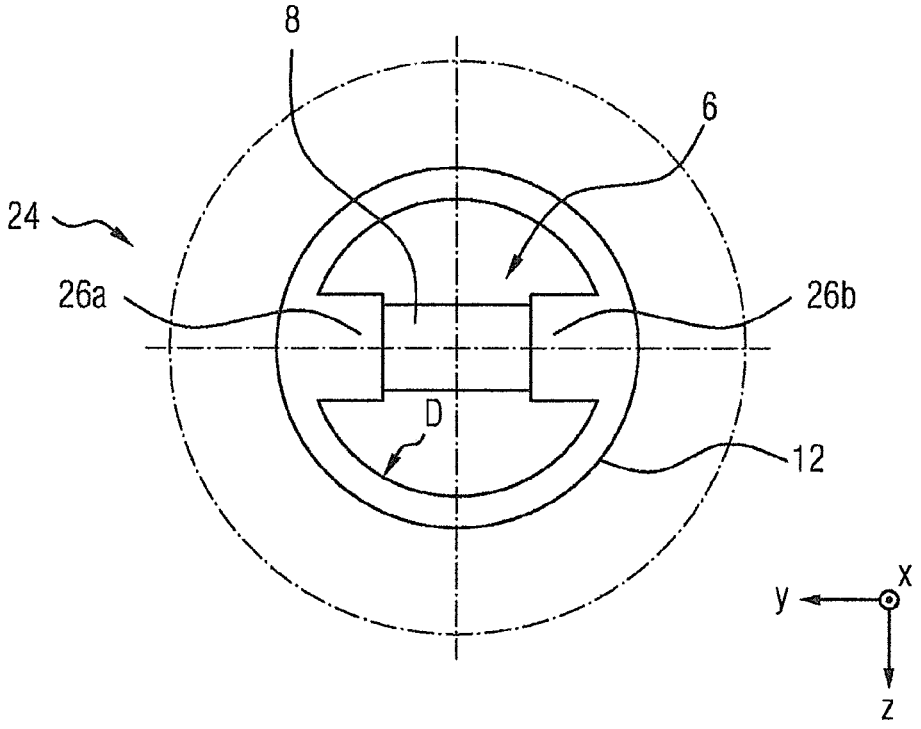
FIG. 5 shows a plan view relevant to FIG. 3.

FIG. 5 schematically illustrates a plan view relevant to FIG. 3. The two projections 26*a*, 26*b* are visible, these extending from a diameter D, which delimits the inlet opening 6, into the inlet opening 6. Here, the diameter does not necessarily have to be understood in relation to a circular inlet opening, but rather as a contour circumscribing an inlet. The cuboidal insert 8 functioning as an abutment bears between the two projections 26*a*, 26*b*.

In a plan view (not illustrated here) relating to FIG. 4, the cuboidal abutment 8 would be concealed by the web section 28 connecting the two projections 26*a*, 26*b* to one another.

The outer circle illustrated by dash-dotted lines in FIG. 5 illustrates here a section of the pump cover 12 that is flange-like on the pressure side, wherein the flange-like section is rolled together with the electric motor mentioned at the beginning by the sheet-metal casing or sheet-metal cylinder (cf. FIG. 1 and FIG. 2).

FIGS. 3, 4 and 5 are purely schematic illustrations for illustrating the invention.

In a further embodiment (not illustrated here), the pump cover 12—analogously to FIG. 2—may have a pump housing section 24 formed in a manner orthogonal (cf. Y-Y direction or transverse direction) to a longitudinal direction X-X of the pump 4 and from which the two projections 26*a*, 26*b* extend into the inlet opening 6 of the pump cover 12, for example in a manner orthogonal to the longitudinal direction X-X.

A common feature of the embodiments in FIGS. 3, 4 and 5 is that the insert 8 is clamped into the receptacle of the pump cover, which receptacle is formed by the two projections 26*a*, 26*b*, utilizing a height dimension or width dimension of the insert 8. Here, the receptacle may in principle be provided in a pump housing, or else in a pump cover as part of a pump housing.

A further common feature of the embodiments in FIGS. 3, 4 and 5 is that the cross-sectional dimension which actually serves for clamping in the use position of the insert 8 may be understood as being the clamping dimension of the insert, wherein the clamping dimension in the use position of the insert is to be understood as being the width dimension.

Although exemplary embodiments have been discussed in the above description, it should be noted that numerous modifications are possible. Furthermore, it should be noted that the exemplary embodiments are merely examples which are not intended to limit the scope of protection, the applications and the structure in any way. Rather, a person skilled in the art will take from the above description a guideline for implementation of at least one exemplary embodiment, wherein various modifications may be made, in particular with regard to the function and arrangement of the described components, without departing from the scope of protection as can be gathered from the claims and equivalent feature combinations.

The invention claimed is:

1. A screw-spindle pump comprising:

a first screw spindle (14) and a second screw spindle (16), wherein the second screw spindle (16) is a drive spindle and the first screw spindle (14) is a running spindle that runs oppositely with respect to the second screw spindle (16), and a pump housing (10) configured to receive the first and second screw spindles (14, 16), wherein the first and second screw spindles (14, 16) form, together with at least the pump housing (10), delivery chambers (18), which move from a suction side (20) of the screw-spindle pump to a pressure side (22) of the screw-spindle pump as a consequence of a rotation of the first and second screw spindles (14, 16), wherein a pump housing section (24) has an elongate insert (8), as an abutment for the first and second screw spindles (14, 16) and against which the first and second screw spindles (14, 16) are supported, the elongate insert (8) having a first portion forming a first abutment for the second screw spindle (16) and a second portion forming a second abutment for the first screw spindle (14), the pump housing section (24) further comprising first and second projections (26*a*, 26*b*), and wherein the elongate insert (8) is in the shape of an elongate cuboid having a longitudinal extent, a height cross-sectional dimension and a width cross-sectional dimension, and is clamped into a receptacle of the pump housing section (24), the receptacle being formed by the first and second projections (26*a*, 26*b*), the clamping being by the first and second projections (26*a*, 26*b*) bearing upon one selected from the group consisting of the height cross-sectional dimension and the width section dimension of the elongate insert (8), but not bearing upon either of first and second ends of the elongate insert (8) with respect to the longitudinal extent of the elongate insert (8), so as to maintain respective first and second spacings (27*a*, 27*b*) between respective first and second ends of the elongate insert (8) and the first and second projections (26*a*, 26*b*), respectively.

2. The screw-spindle pump as claimed in claim 1, wherein the width cross-sectional dimension of the elongate insert (8) is equal to the height cross-sectional dimension of the elongate insert (8).

3. The screw-spindle pump as claimed in claim 2, wherein the the first and second projections (26*a*, 26*b*) extend from the pump housing (10) into an inlet opening (6) of the pump housing (10) transverse to a longitudinal direction (X-X) of the pump housing.

4. The screw-spindle pump as claimed in claim 3, wherein the first and second projections (26*a*, 26*b*) are arranged so as to project orthogonal to the longitudinal direction (X-X) of the screw-spindle pump (4).

5. The screw-spindle pump as claimed in claim 4, further comprising a pump housing section (24) arranged transverse to the longitudinal direction (X-X) of the screw-spindle pump (4) and on which the first and second projections (26*a*, 26*b*) are formed.

6. The screw-spindle pump as claimed in claim 5, wherein the first projection (26*a*) and the second projection (26*b*) are arranged on the pump housing (10, 24) so as to diametrically oppose one another.

7. The screw-spindle pump as claimed in claim 1, wherein the elongate insert (8) is made from one selected from the group consisting of: a ceramic, a metal and a plastic.

8. The screw-spindle pump as claimed in claim 1, wherein the pump housing (10) has a pump cover (12), in which the elongate insert (8) is clamped between the first and second projections (26*a*, 26*b*).

9. The screw-spindle pump as claimed in claim 8, wherein at least one selected from the group consisting of the pump housing (10) and the pump cover (12) is formed as an injection molding.

* * * * *